United States Patent [19]

Fontaine

[11] Patent Number: 4,737,599

[45] Date of Patent: Apr. 12, 1988

[54] ELECTRIC OUTLET SAFETY COVER

[76] Inventor: Serge Fontaine, 1440 W. Fletcher, Chicago, Ill. 60657

[21] Appl. No.: 914,287

[22] Filed: Oct. 2, 1986

[51] Int. Cl.[4] ..... H01R 13/447

[52] U.S. Cl. ..... 174/67

[58] Field of Search ..... 174/67; 220/242; 339/36; 439/135, 136

[56] References Cited

U.S. PATENT DOCUMENTS

| | | | |
|---|---|---|---|
| 2,033,602 | 3/1936 | Adam . | |
| 2,477,803 | 8/1949 | Huber . | |
| 2,516,464 | 7/1950 | Hooser . | |
| 2,526,606 | 10/1950 | Gregg | 174/67 |
| 2,641,627 | 6/1953 | Lewis | 174/67 |
| 2,710,382 | 6/1955 | Fitzpatrick et al. | 339/40 |
| 2,820,842 | 1/1958 | Meistrell | 174/67 |
| 2,988,242 | 6/1961 | Kneip | 174/67 X |
| 2,996,566 | 8/1961 | Stas | 174/53 |
| 3,027,416 | 3/1962 | Kissel | 174/57 |
| 3,068,442 | 12/1962 | Kubik et al. | 339/36 |
| 3,096,409 | 7/1963 | Hubbell et al. | 200/14 |
| 3,204,807 | 9/1965 | Ramsing | 220/24.3 |
| 3,467,763 | 9/1969 | Shaw | 174/67 |
| 3,865,456 | 2/1975 | Dola | 339/40 |
| 3,932,696 | 1/1976 | Fork et al. | 174/48 |
| 3,956,573 | 5/1976 | Myers et al. | 174/48 |
| 3,972,579 | 8/1976 | Kohaut | 339/34 |
| 4,036,396 | 7/1977 | Kennedy et al. | 174/67 X |
| 4,070,078 | 1/1978 | Chrones | 339/44 R |
| 4,134,516 | 1/1979 | Sullo | 220/242 |
| 4,289,921 | 9/1981 | Gartner et al. | 174/48 |
| 4,302,624 | 11/1981 | Newman | 174/67 |

*Primary Examiner*—A. T. Grimley
*Assistant Examiner*—David A. Tone
*Attorney, Agent, or Firm*—Wood, Dalton, Phillips, Mason & Rowe

[57] ABSTRACT

In accordance with the present invention an electric outlet safety cover is provided comprising a base member with an aperture for placement over an electric outlet in a receptacle, a flat cover member slidably mounted relative to the base member, wherein the cover member is selectively, slidably positionable to alternatively cover and expose the aperture and thereby the electric outlet and a receiving member adjacent to the base member for receiving the cover member with the cover member positioned to expose the aperture and electric outlet.

14 Claims, 1 Drawing Sheet

FIG. 1
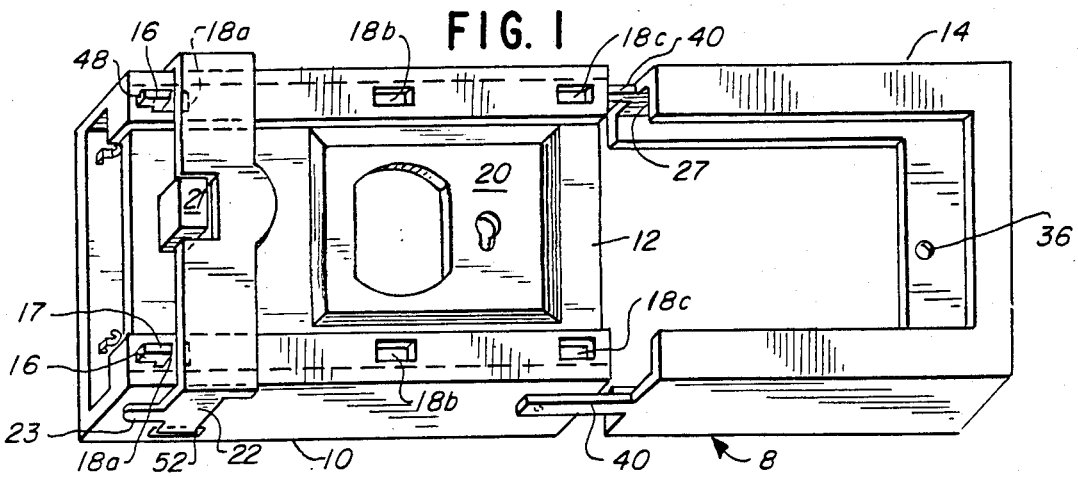
FIG. 2
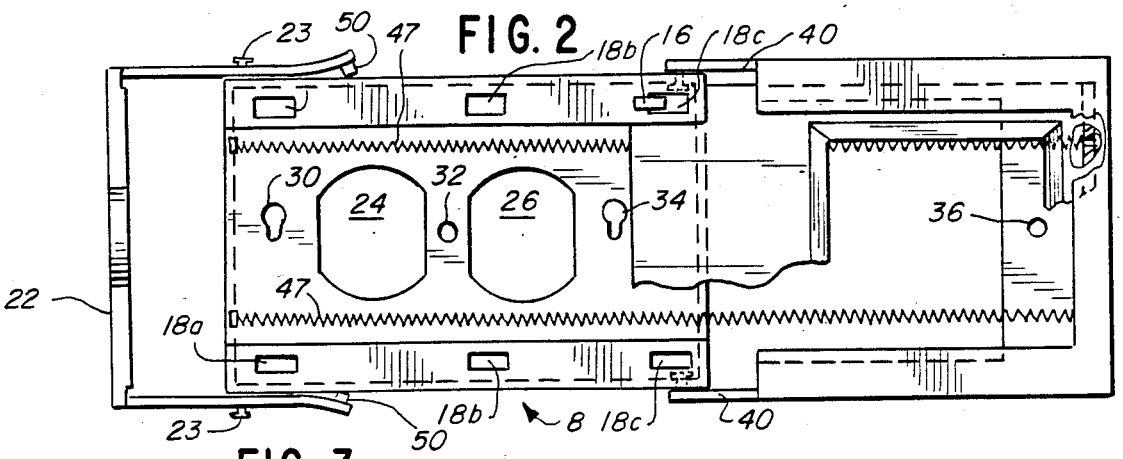
FIG. 3
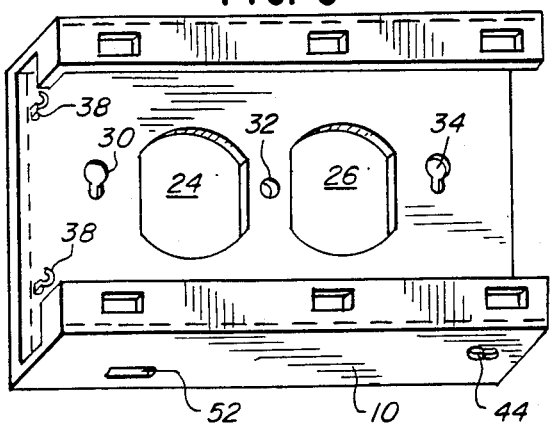
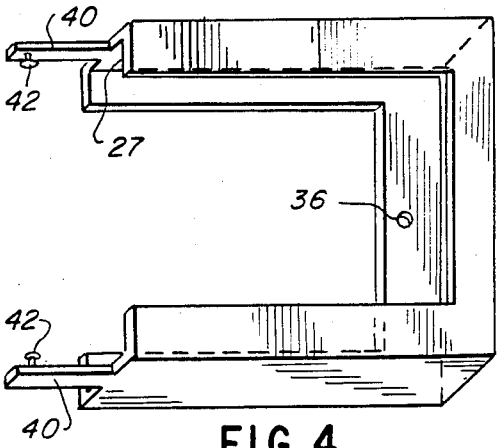
FIG. 4
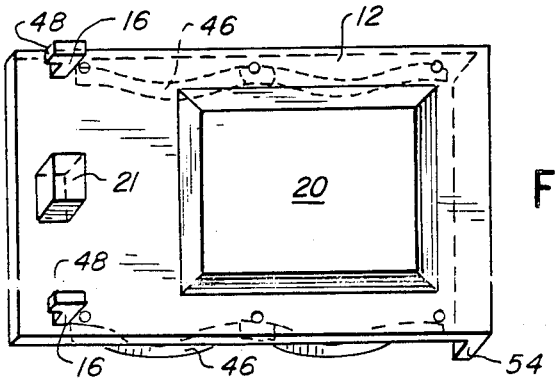
FIG. 5

ELECTRIC OUTLET SAFETY COVER

FIELD OF THE INVENTION

The present invention relates to electric outlet covers and, more particularly, to an electric outlet safety cover to selectively prohibit access to an electric outlet.

BACKGROUND OF THE ART

Due to their typical location near the floor, electric outlets continue to pose a serious inherent safety problem to children and others not understanding the danger of electrical shock.

Various attempts have been made to reduce the inherent danger of electric outlets, but these have to date proved unsatisfactory.

Plastic plugs are available for insertion into empty electric outlets, but these plastic plugs are often misplaced when removed and, therefore unavailable when needed.

Complete outlet covers have been provided, eliminating the problem with plastic covers described above. However these covers are still unsatisfactory because the cover shield, when positioned to expose the electric outlet, is susceptible to being torn away, whether intentionally or not. See for example Hooser, U.S. Pat. No. 2,516,464, Kubik et al, U.S. Pat. No. 3,068,442 and Myers et al, U.S. Pat. No. 3,956,573.

Other designs have incorporated slidable shutters covering each outlet opening, with the slidable shutters being slid or rotated by the plug as the plug is inserted, thereby exposing the outlet openings. See for example Dola, U.S. Pat. No. 3,865,456, Meistrell, U.S. Pat. No. 2,820,842, Fitzpatrick et al, U.S. Pat. No. 2,710,382, Lewis, U.S. Pat. No. 2,641,627 and Huber, U.S. Pat. No. 2,477,803. Such devices are typically difficult to correctly position in order to insert the plug.

SUMMARY OF THE INVENTION

In accordance with the present invention an electric outlet safety cover is provided comprising a base member with an aperture for placement over an electric outlet in a receptacle, a flat cover member slidably mounted relative to the base member, wherein the cover member is selectively, slidably positionable to alternatively cover and expose the aperture and thereby the electric outlet and a receiving member adjacent to the base member for receiving the cover member with the cover member positioned to expose the aperture and electric outlet.

The receiving member seats closely against a wall to which the electric outlet safety cover attaches and blocks access and possible prying loose of the cover member from behind the cover member. The receiving member also has a shoulder to confine movement of the cover member away from a wall to which the safety cover is attached.

The cover member has a tab and the base member has a plurality of spaced openings for receiving the tab to thereby consistently locate and maintain the cover member in both a first position wherein the cover member covers the aperture and a second position wherein the aperture is exposed. The cover member is biased toward the base member and the tab is configured so that the bias maintains the tabs in a selected one of the openings.

The safety cover further has a pivoting member which serves as an additional safeguard and blocks both the tab and a post on a cover member with the cover member in its closed position.

BRIEF DESCRIPTION OF THE DRAWINGS

Other features and advantages of the invention will be apparent from the following description taken in connection with the drawings wherein:

FIG. 1 is a perspective view of an electric outlet safety cover according to the present invention with a cover member thereon positioned to cover the electric outlets of a duplex receptacle;

FIG. 2 is a front, elevation view of the electric outlet safety cover with the cover member positioned to expose both electric outlets of duplex receptacle;

FIG. 3 is a perspective view of a base member on the electric outlet safety cover of FIGS. 1 and 2;

FIG. 4 is a perspective view of a receiving member for the cover member on the electric outlet safety cover of FIGS. 1 and 2; and FIG. 5 is a perspective view of the cover member.

DESCRIPTION OF THE PREFERRED EMBODIMENT

In FIG. 1 an electric outlet safety cover, generally designated 8, is illustrated, comprising a base member 10, a cover member 12 and a U-shaped receiving member 14. The cover member 12 is selectively slidable between the base member 10 and the receiving member 14 for cooperation therewith, as described below.

The cover member, as shown in FIGS. 1, 2 and 5, has a pair of L-shaped tabs 16, and the tabs 16 are received on by one of first, second or third pairs of openings **18*a*, 18*b*, or 18*c*, as determined by the position of the cover member 12 relative to the base member 10. The cover member 12 has a recess 20 and a post 21 which facilitate grasping and sliding of the cover member 12 by a user. The base member 10 further has a member 22, which is pivotable about a pair of pins 23 on the base member 10. When positioned as shown in FIG. 1, the pivotable member 22 blocks the tabs 16 and post 21** to prevent sliding of the cover member relative to the base.

In FIG. 2, the cover member 12 is positioned within the receiving member 14, thereby exposing left and right aperture 24, 26. The cover member 12 selectively covers both apertures 24, 26, only the right aperture 26, or neither of the apertures 24, 26. As will be discussed in greater detail later, the left and right apertures 24, 26 expose both electric outlets of a duplex receptacle when mounted over the same.

The electric outlet safety cover typically is mounted over a duplex receptacle on a wall and first, second, third and fourth screw openings 30, 32, 34 and 36, respectively, are utilized to mount the electric outlet safety cover 8 in position. The first and third screw openings each receives a screw to be retained by a standard electrical outlet box (not shown) which houses the electric duplex receptacle. The second screw opening 32 receives a screw to be retained by the electrical duplex outlet. The fourth screw opening 36 receives a screw to anchor the receiving member 14 against the wall. To further anchor the receiving member 14 against the wall, two sided tape (not shown) may be applied between the receiving member 14 and the wall.

The tabs 16 are positioned in FIG. 2 in the third pair of openings holes 18c, thereby exposing both the left and the right apertures 24, 26. If only one electric outlet is required at a given time, the tabs 16 would be positioned in the second pair of openings 18*b*, thereby covering the right aperture 26 while continuing to expose the left aperture 24.

The receiving member 14 is illustrated in FIG. 4 and has two arms 40. Each of the arms 40 has pins 42 to be received by respective openings 44 of the base member 10 (see FIG. 3). With the cover member 12 in the FIG. 2 position a U-shaped shoulder 27 therein faces the cover member and prohibits the cover member from being pried outwardly from the wall.

To assemble the electric outlet safety cover 8, the base member 10 is first attached to the wall by screws directed through the first, second and third screw openings 30, 32, 34. The cover member 12 is then slidably inserted into the base member 10 and the receiving member 14 is attached to the base member 10 inserting the pins 42 into the openings 44. The receiving member 14 is then attached to the wall by two sided tape and a screw received through the fourth screw opening 36.

A pair of leaf springs 46 is illustrated in phantom in FIG. 5. The leaf springs 46 bias the cover member 12 away from the wall, maintaining the tabs 16 in the preselected opening pair 18*a*, 18*b* or 18*c*.

A pair of helical springs 47 extends from the left side of the base member 10 to the right side of the cover member 12 (as viewed in FIG. 3). The helical springs 47 bias the cover member 12 leftward in the drawings relative to the base member 10 and are held on the base member 10 by a pair of hooks 38 (as illustrated in FIG. 4).

As shown in FIG. 5, the tabs 16 are "L" shaped and each includes portion 48. With the tabs 16 inserted into one of the pairs of openings 18*a*, 18*b*, or 18*c*, and the cover member 12 biased leftward due to the pair of helical springs 47, the free end portions 48 overlie a solid portion of the base member 10, thereby preventing simple inward pressure on the cover member 12 from releasing the tabs 16 from the openings 18. Thus, to move the cover member 12, one must first release the tabs 16 from their respective openings by first moving the cover member 12 slightly rightward and then towards the wall.

As a further safeguard against movement of the cover member relative to the base member with the cover member in its FIG. 1 position, the pivotable member 22 can be closed, as illustrated in FIG. 1, to block the post 21 and tabs thereby preventing sliding of the cover and release of the tabs 16 from the first pair of openings 18*a*. To maintain the pivotable member 22 in the closed position, a pair of posts 50 are provided on the member 22 and seat in slots 52 on the base member 10 upon the closed position being realized.

The cover member 12 is illustrated in FIG. 5 and further has an offset edge 54. The edge 54 is presented flushly against the wall, thereby preventing one from inserting an object such as a finger or other tool behind the cover member 12 to break or remove the cover member 12.

The electric outlet safety cover 8 disclosed herein can be effectively utilized to cover any number of electric outlets, whether they are simplex, duplex or another configuration.

I claim:

1. An electric outlet safety cover comprising:

a base member having at least one aperture to permit access to an electric outlet;

a cover member having a generally flat configuration with a flat front surface and an offset edge on the cover member for placement against a wall to which the electric outlet safety cover is attached to prevent prying of the cover member;

means mounting the cover member for movement relative to the base member between a first position wherein the cover member overlies and covers said one aperture and a second position wherein the one aperture is exposed and at least a portion of the cover member is in non-overlying relationship with the base member; and means for receiving the cover member portion with the cover member in said second position.

2. The electric outlet safety cover of claim 1 wherein means are provided for removably attaching the receiving means to the base member.

3. The electric outlet safety cover of claim 1 wherein means are provided for consistently locating and retaining said cover member in each of said first and second positions.

4. The electric outlet safety cover of claim 3 wherein the means for consistently locating and retaining comprises:

a tab on one of the cover member and base member;

first and second spaced openings on the other of the cover member and base member for selectively receiving the tab in each of the first and second position of the cover member; and means for biasably maintaining the tabs in each of the first and second openings.

5. The electric outlet safety cover of claim 1 wherein said means for mounting the cover member mount the cover member for sliding movement relative to the base member.

6. The electric outlet safety cover of claim 1 wherein said cover member has a front side and said means for receiving the cover member portion has a shoulder facing said front side to confine forward movement of the cover member.

7. The electric outlet safety cover of claim 1 wherein means are provided for removably attaching the receiving means to the base member.

8. The electric outlet safety cover of claim 1 wherein means are provided for consistently locating and retaining said cover member in each of said first and second positions.

9. The electric outlet safety cover of claim 1 wherein said means for mounting the cover member mount the cover member for sliding movement relative to the base member.

10. The electric outlet safety cover of claim 1 wherein said cover member has a front side and said receiving member has a shoulder facing said front side to confine forward movement of the cover member.

11. An electric outlet safety cover comprising:

a base member having at least one aperture to permit access to an electric outlet;

a cover member;

means mounting the cover member for movement relative to the base member between a first position wherein the cover member overlies and covers said one aperture and a second position wherein the one aperture is exposed and at least a portion of the cover member is in non-overlying relationship with the base member;

means for receiving the cover member portion with the cover member in said second position;

means for consistently locating and retaining said cover member in each of said first and second positions, sad locating and retaining means comprising a tab on one of the cover member and base member, first and second spaced openings on the other of the cover member and base member for selectively receiving the tab in each of the first and second positions of the cover member, and means for biasably maintaining the tabs in each of the first and second openings; and a pivoting member and means mounting the pivoting member for movement relative to the base member between locked and unlocked positions, said pivoting member in said locked position blocking movement of the cover member relative to the base member.

12. The electric outlet safety cover of claim 11 wherein means are provided for removably attaching the receiving means to the base member.

13. The electric outlet safety cover of claim 11 wherein said means for mounting the cover member mount the cover member for sliding movement relative to the base member.

14. The electric outlet safety cover of claim 11 wherein said cover member has a front side and said receiving member has a shoulder facing said front side to confine forward movement of the cover member.

* * * * *